United States Patent [19]

Hostetler

[11] 4,421,600

[45] Dec. 20, 1983

[54] TRI-NIP PAPERMAKING SYSTEM

[75] Inventor: Ronald E. Hostetler, Vancouver, Wash.

[73] Assignee: Crown Zellerbach Corporation, San Francisco, Calif.

[21] Appl. No.: 280,752

[22] Filed: Jul. 6, 1981

[51] Int. Cl.[3] ..... D21H 5/24

[52] U.S. Cl. ..... 162/111; 162/113; 162/117

[58] Field Search ..... 162/111, 113, 117, 281, 358, 360 R, 162/205, 359, 116

[56] References Cited

U.S. PATENT DOCUMENTS 2,744,453 5/1956 Hornbostel ..... 162/359

4,309,246 1/1982 Hulit et al. ..... 162/113

*Primary Examiner*—Peter Chin

*Attorney, Agent, or Firm*—Thomas R. Lampe

[57] ABSTRACT

A system for producing a bulky, soft and absorbent paper web wherein the web is directed through a first nip formed by two dewatering felts, a second nip formed between a dewatering felt and an imprinting fabric of a specified character, and a third nip formed between the imprinting fabric and creping surface.

8 Claims, 2 Drawing Figures

TRI-NIP PAPERMAKING SYSTEM

BACKGROUND OF INVENTION

1. Field of Invention

This invention relates to a method and apparatus for manufacturing a bulky, soft and absorbent paper web.

2. Description of the Prior Art

U.S. patent application Ser. No. 933,203, Hulit et al., filed Aug. 14, 1978, now U.S. Pat. No. 4,309,246, issued Jan. 5, 1982, relates to a system for producing a bulky, soft and absorbent creped paper web using mechanical means to pre-dry the web. The structure for pre-drying the web includes a papermakers' felt, an imprinting fabric of a specified character and a pair of opposed rolls creating a compression nip defined by the fabric and felt through which the web is passed and partially dewatered. According to the aforesaid application, the web prior to entering the fabric-felt compression nip is essentially uncompacted and the fabric-felt arrangement comprises the initial pre-drying stage in the system. Since the imprinting fabric then carries the pre-dried web in undisturbed condition to a Yankee dryer or other component defining a heated drying surface, the only significant compacting of the web that occurs in the system of the aforesaid application is at the locations of the compaction elements or knuckles of the imprinting fabric. As a consequence, a soft, bulky, and absorbent sheet is produced through use of the system covered thereby.

While the system described in the aforesaid application was specifically designed to avoid overall compaction of the web, it has subsequently been found that the fabric-felt nip defining means described therein can also be used to advantage when utilized downstream from a preliminary dewatering mechanism whereat the web is mechanically dewatered through overall compaction thereof. In particular, it has been found that the web can be re-bulked to a significant degree through use of imprinting fabric-felt nip defining means when such nip defining means is utilized in conjunction with a preliminary dewatering component which compacts the web overall in order to obtain efficient removal of water from the web while at the same time producing the undesirable result of reducing its bulk, softness and absorbency.

BRIEF SUMMARY OF THE INVENTION

According to the present invention a system for manufacturing a bulky, soft and absorbent paper web is provided. In accordance with the teachings of the invention a wet web of principally lignocellulosic fibers is positioned on a first dewatering felt and then conveyed by said felt through a first nip formed by it and a second dewatering felt to remove water from the web. The partially dewatered web is then conveyed to a second nip formed between a dewatering felt and an open mesh imprinting fabric formed of woven filaments, said fabric having spaced compaction elements and defining voids between the filaments. While the partially dewatered web is in the second nip, it is impressed against the fabric by the felt to force a predetermined portion of the web into the voids and provide bulk thereto. The web is then retained on the imprinting fabric after the web passes through the second nip and removed therefrom before final drying by applying the web to a creping surface at a third nip location, said third nip being formed between the creping surface and the imprinting fabric. The web is retained on the imprinting fabric in an essentially undisturbed condition during retention and transport thereof on the imprinting fabric between the second and third nips.

DESCRIPTION OF THE PREFERRED EMBODIMENTS

Figure 1:
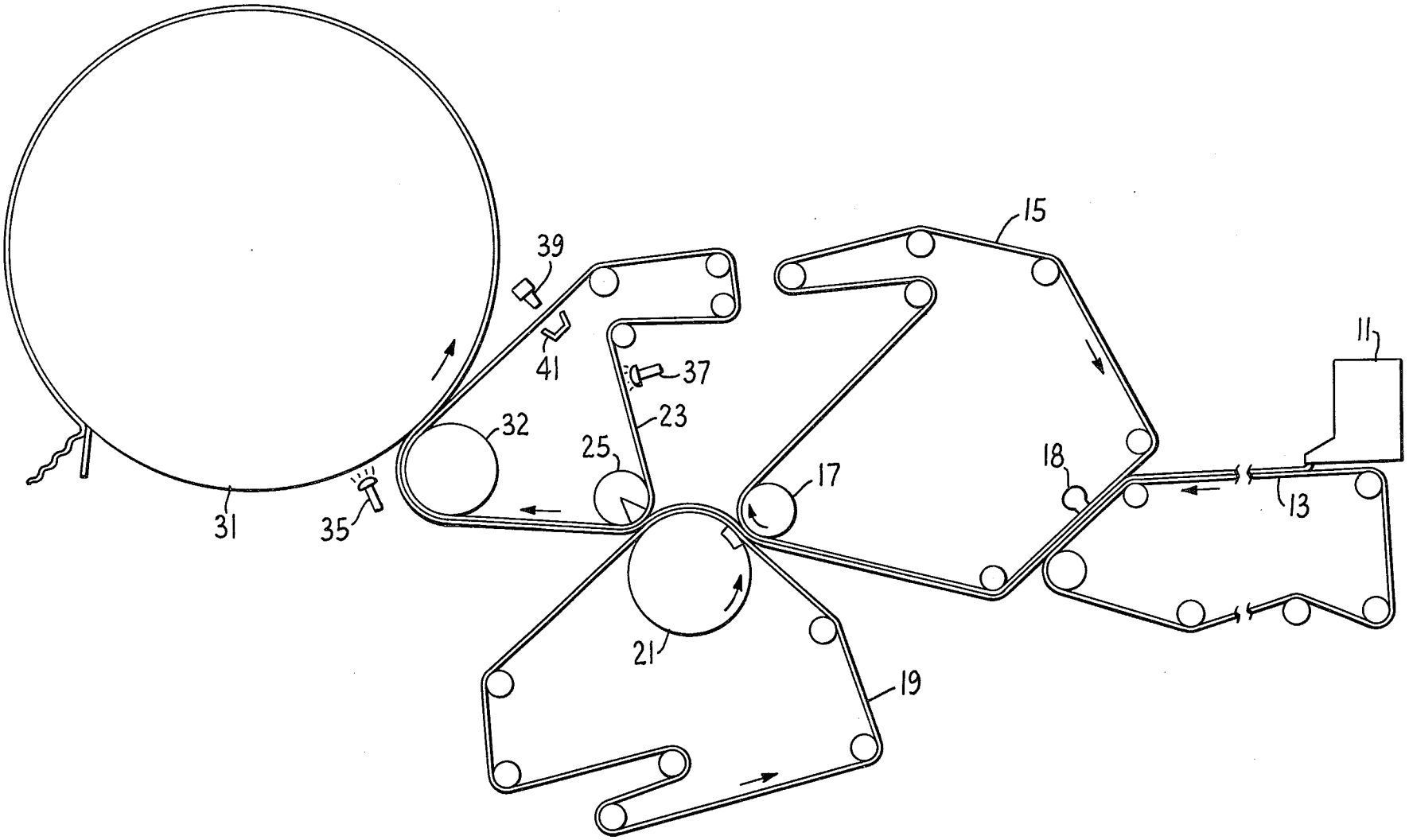
FIG. 1 is a schematic side view of apparatus constructed in accordance with the teachings of the present invention for carrying out the method thereof.

Referring now to FIG. 1, a papermaking machine constructed in accordance with the teachings of the present invention is illustrated. The machine includes a paper web-forming device of any suitable type. In the FIG. 1 embodiment such device comprises a head box 11 and a Fourdrinier wire 13 which receives the web slurry from the head box in the usual manner. Fourdrinier wire 13 delivers the wet web to a papermakers' dewatering felt 15 which is disposed upon rollers to define an endless loop. One of the rollers, as for example roller 17, is a drive roller to cause felt 15 to move in a clockwise direction as viewed in FIG. 1. A suction box 18 assists in the transfer of the wet web from Fourdrinier wire 13 to felt 15.

The papermakers' dewatering felt 15 forms a nip with a second papermakers' dewatering felt 19. Felt 19 forms a continuous loop about a plurality of support rollers and vacuum roll 21. Vacuum roll 21 and roll 17 exert a nip pressure on the dewatering felts and the wet paper web passing therethrough in the range of from about 50 pli to about 750 pli. It will be appreciated that water will be expressed from the wet web in this first nip and transferred to the dewatering felts in a well known manner. When the web leaves the aforedescribed first nip it is partially dewatered to an overall fiber consistency of from about 22% to about 35%. Suitable vacuum or other means (not shown) are used to continually remove excess water from the dewatering felts after passing through the nip in a well known manner.

After passing through the first nip the partially dewatered web is transferred to dewatering felt 19 and carried about vacuum roll 21 until the web enters a second nip. The second nip is formed between dewatering felt 19 and a continuous loop of imprinting fabric 23 which is driven in a clockwise direction as viewed in FIG. 1 by one or more the support rolls supporting the fabric. One of the fabric support rolls 25 is pressured against vacuum roll 21 so that the pressure at the second nip is in the range of from about 50 pli to about 500 pli. At this second nip the partially dewatered paper web is transferred to the fabric.

U.S. patent application Ser. No. 933,203, Hulit et al., filed Aug. 14, 1978, now U.S. Pat. No. 4,309,246, issued Jan. 5, 1982, may be referred to for details of an imprinting fabric of the type preferred for use in connection with the present invention. Specifically, the imprinting fabric disclosed therein is an open mesh fabric formed of woven filaments. The fabric has compaction elements defined by the knuckles formed at the warp and weft crossover points of the fabric filaments and defines voids between the filaments. The imprinting fabric has a surface void volume of from about 15 $cc/m^2$ to about 250 $cc/m^2$ and preferably from about 40 $cc/m^2$ to about 150 cc/m$^2$. The compaction element area of the imprinting fabric constitutes between about 5% and about 50%, and preferably from about 20% to about 35%, of the total web supporting surface area of the fabric. As noted in the aforesaid application, an imprinting fabric of the type just described will retain a wet paper web impressed therein by a papermakers' dewatering felt to remove the web from the felt. In the arrangement illustrated in FIG. 1, transfer to the imprinting fabric 23 is assisted by the vacuum applied to the fabric by vacuum roll 25. It will be appreciated that impression of the wet web into the voids of the imprinting fabric will increase the apparent bulk of the web even though the web has been compacted overall at the first nip location. At the second nip from about 5% to about 50% of the web will be compacted and from about 50% to about 95% of the web will be impressed into the voids.

After the paper web has passed through the second nip and is attached to imprinting fabric 23 the imprinting fabric delivers the partially dewatered web to a third nip formed between a Yankee dryer 31 and a Yankee pressure roll 32. The roll 32 is pressured against the Yankee to provide a nip pressure at this third nip in the range of from about 50 pli to about 500 pli. Transfer from the impression fabric to the Yankee is facilitated by the application of an adhesive to either the paper web or the Yankee dryer surface prior to nip formation. In FIG. 1, a spray nozzle 35 is illustrated schematically as one means by which adhesive application may take place. Transfer is also facilitated by application to the imprinting fabric 23 prior to formation of the second nip of a release agent such as a release oil spray. An oil spray nozzle 37 is illustrated schematically in FIG. 1. One specific oil release spray that has been found suitable for the present application is emulsified mineral oil. It has also be found important for the proper operation of the imprinting fabric to thoroughly clean and dry it. One approach that has been utilized for this purpose is to provide a pressurized fabric dewatering box 39 which defines a slot through which air is directed across and through the full width of the fabric after it leaves the Yankee. The air passing through the box 39 displaces water therefrom into an suitable receptacle 41 disposed on the other side of the fabric.

After the web is applied to the Yankee dryer surface drying thereof is completed and the web is creped from the Yankee in the usual manner.

Figure 2:
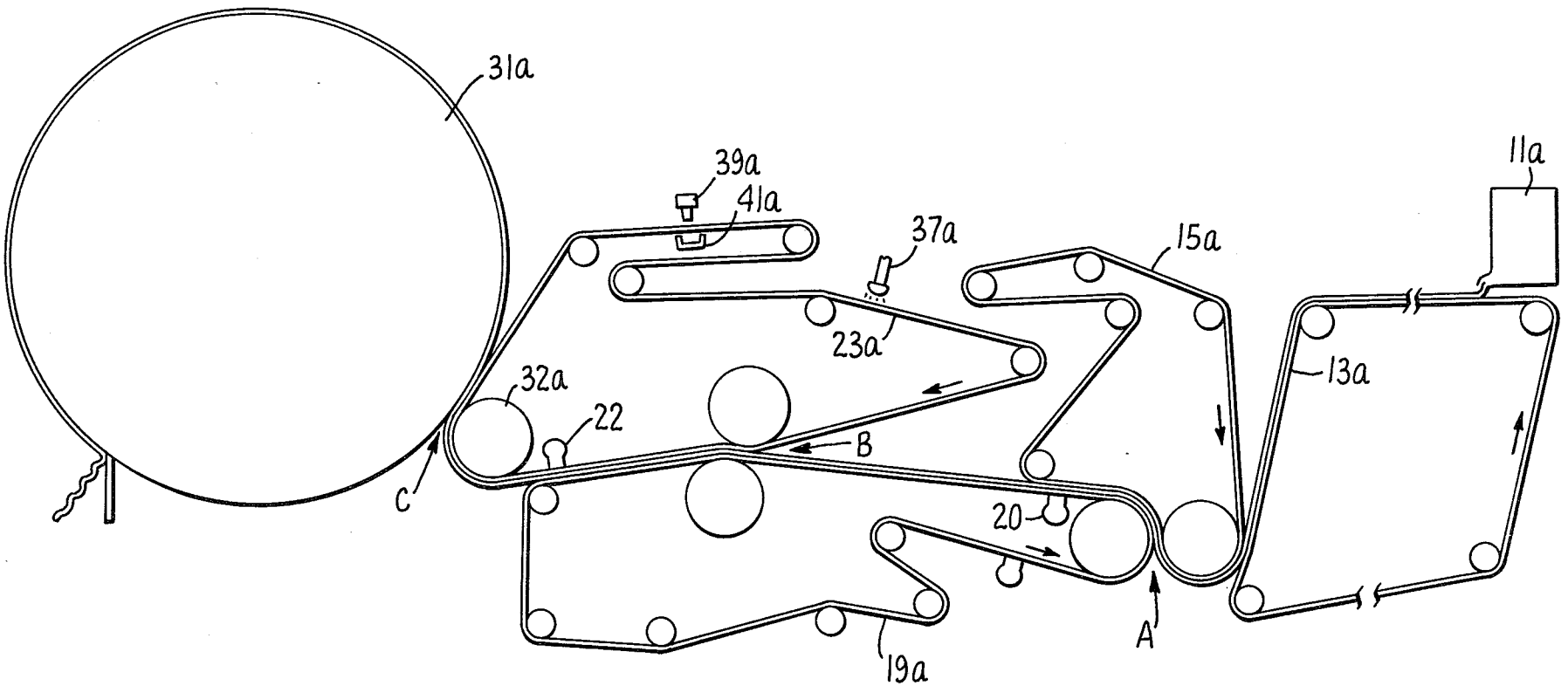
FIG. 2 is a view similar to that of FIG. 1 but illustrating an alternative form of apparatus.

FIG. 2 illustrates in schematic fashion an alternative form of papermaking machine layout incorporating the teachings of the present invention. Slurry delivered from head box 11*a* and Fourdrinier wire 13*a* is transferred to a first felt 15*a* continuously rotating in the direction designated by the arrow. Felt 15*a* forms a first nip with a second felt 19*a* at a first nip location A. A transfer box 20 causes the partially dewatered web to be transferred to felt 19*a* and delivered to a second nip location B formed between felt 19*a* and imprinting fabric 23*a*. Felt 19*a* and fabric 23*a* proceed in common after passing through nip B until they reach second vacuum transfer box 22 which assists in the retention of the web on the imprinting fabric as felt 19*a* diverges therefrom. As was the case with respect to the first embodiment, fabric 23*a* delivers the partially dewatered web to a third nip C formed between a Yankee 31*a* and Yankee pressure roll 32*a*. This embodiment also incorporates a water blowoff box 39*a* and receptacle 41*a* as well a release agent spray nozzle 37*a*.

As previously stated, any suitable papermakers' dewatering felt may be utilized in accordance with the teachings of the present invention. An example of a felt which has been found suitable for practicing the present invention is an Albany medium Durasorb felt manufactured by the Albany Felt Company and comprised of 51% wool and 49% synthetic material. The referenced felt is a medium class needled-felt with a satin weave finish on the sheet surface and having a permeability (expressed in CFM/Ft$^2$/$\frac{1}{2}$"$H_2O$) of 45.

I claim:

1. A method for manufacturing a bulky, soft and absorbent paper web comprising the steps of:

positioning a wet web of principally lignocellulosic fibers on a first dewatering felt;

conveying the wet web while positioned on the first dewatering felt through a first nip formed by said first dewatering felt and a second dewatering felt to provide overall mechanical compaction of said web and partially dewater said web to an overall fiber consistency of from about 22% to about 35%;

conveying said partially dewatered and overall mechanically compacted web to a second nip formed between a dewatering felt and an open mesh imprinting fabric formed of woven filaments, said fabric having spaced compaction elements and defining voids between the filaments;

while the partially dewatered, overall mechanically compacted web is in said second nip, rebulking said overall mechanically compacted web by impressing said web against said fabric whereby from about 5% to about 50% of said web will be compacted by said compaction elements and from about 50% to about 95% of said web will be impressed into said voids and displaced from the portion of the web compacted by said compaction elements;

retaining the rebulked web on said imprinting fabric after the rebulked web passes through said second nip; and removing the rebulked web from the imprinting fabric before final drying thereof by applying the rebulked web to a creping surface at a third nip location, said third nip being formed between the creping surface and the imprinting fabric, and said rebulked web being retained on the imprinting fabric in an essentially undisturbed condition during retention thereof on said imprinting fabric between said second and third nips.

2. The method of claim 1 wherein a release agent is applied to said imprinting fabric prior to entry of said imprinting fabric into said second nip.

3. The method of claim 1 wherein a nip pressure in the range of from about 50 pli to about 750 pli is maintained at said first nip.

4. The method of claim 1 wherein a nip pressure in the range of from about 50 pli to about 500 pli is maintained at said second nip.

5. The method of claim 1 wherein a nip pressure in the range of from about 50 pli to about 500 pli is maintained at said third nip.

6. The method of claim 1 comprising the additional step of directing an air flow through said imprinting fabric to remove water therefrom after said imprinting fabric forms said third nip.

7. The method of claim 1 wherein said web at the time it enters said third nip has an overall fiber consistency of from about 22% to about 35%.

8. The method of claim 1 wherein the step of conveying the partially dewatered web to said second nip is carried out by retaining said web on one of the felts forming the first nip and transporting the felt between the first and second nips.

* * * * *